US005088011A

United States Patent [19]

Williams et al.

[11] Patent Number: 5,088,011

[45] Date of Patent: Feb. 11, 1992

[54] HEADLAMP CAPSULE BASE WITH FORMED SEAL LUG

[75] Inventors: Warren F. Williams, Warner, N.H.; John F. Culver, Russel, Pa.

[73] Assignee: GTE Products Corporation, Danvers, Mass.

[21] Appl. No.: 632,570

[22] Filed: Dec. 24, 1990

[51] Int. Cl.[5] ..... F21M 3/02

[52] U.S. Cl. ..... 362/61; 362/267; 313/318

[58] Field of Search ..... 362/61, 80, 226, 267; 313/318

[56] References Cited

U.S. PATENT DOCUMENTS 4,507,712 3/1985 Dolan et al. ..... 362/267
4,609,877 9/1986 Eckardt et al. ..... 362/267
4,622,486 11/1986 Endo ..... 313/318
4,769,574 9/1988 Nagasawa et al. ..... 313/318
4,789,920 12/1988 Helbig et al. ..... 362/367

*Primary Examiner*—Ira S. Lazarus
*Assistant Examiner*—Richard R. Cole
*Attorney, Agent, or Firm*—William F. Meyer

[57] ABSTRACT

A headlamp capsule with a formed lug seal is disclosed. The base of the capsule includes an intermediate wall separating a plug chamber and a lamp chamber. An electrical lug connection is formed in the intermediate wall to couple the two chambers. A walled structure is formed that includes positioning features to align and hold the lug. The accuracy of lug location may thereby be improved. The wall structure also provides a reservoir to hold a liquid sealant around the lug. The reservoir may be made to form with the lug, and thereby substantially reduce the amount of the sealant needed for a durable seal.

26 Claims, 2 Drawing Sheets

HEADLAMP CAPSULE BASE WITH FORMED SEAL LUG

Technical Field

The invention relates to headlamps and particularly to replaceable capsules supporting a light source for a headlamp. More particularly the invention is concerned with a seal for the lugs in a replaceable headlamp capsule.

Background Art

Headlamps made with replaceable lamp capsules are displacing the older style sealed beam headlamp. The capsules are inserted in the rear of the headlamp reflector and lens cavity and then locked in place. The lamp capsule may include a bayonet locking structure, or may have a lock ring feature that allows the lamp capsule to be securely coupled and aligned in the headlamp reflector. A quality seal is made between the lamp capsule and the headlamp reflector that is typically made by an 0-ring structure. A power cable is then coupled to the exterior rear of the capsule.

The coupling to the rear of the capsule has posed a number of problems. In particular, water may pass along the lead connections into the headlamp cavity. The heating and cooling cycles of headlamp operation pressurize and then depressurize the lamp and can pump water vapor into the enclosed volume. The water then fogs the headlamp, and degrades the life of the lamp capsule. The leakage problem has generally been solved by filling the whole interior base of the lamp capsule around the lug connectors with a potting material. The potting material must withstand moderate temperature extremes, resist water, and other chemical exposure. The potting material must also endure the mechanical stress exerted between the lugs and capsule base when the plug connection is made. As a result, the potting material is expensive. There is then a need to limit the amount of the potting material used.

The plug connection made in the rear of the lamp capsule is commonly oriented by the tubular extension of the rear cavity, and the keying structures molded in the capsule base. Theoretically, plugging the power cable to the capsule back should occur correctly, provided the lugs are in the proper position. Lug positioning has been previously accomplished by proper shaping of the lugs followed by proper riveting, or welding of the lugs in place along the base of the capsule. A small problem in alignment would not normally appear to be a significant problem. However, in the automobile assembly, if the lugs are not positioned correctly, insertion of the power cable, without proper lug alignment, can cause the lugs to be further bent. The lamp capsule, or power cable may be injured. Repair procedures must then be initiated, upsetting the assembly procedure and causing delay. One delay in a thousand cars may be more costly in labor and machine down time than the small cost of an improved plug design. There is then a need for assuring the lugs in the lamp capsule are properly positioned.

Disclosure of the Invention

A base for a for headlamp capsule may be formed as a molded body having an open ended plug chamber having an axis. The molded body further includes an intermediate wall formed as an end of the plug chamber. A lamp chamber is formed on the opposite side of the intermediate wall. A walled region formed on the intermediate wall facing the plug chamber is formed having an interior wall defining a surrounded lug well. The lug well has an area substantially less than the area of the intermediate wall. The lug well connects by a lug passage having a minor dimension through the intermediate wall to the lamp chamber. Formed features in the lug well help to accurately position, and hold the lug, while the well contains and concentrates the sealant around the lug, thereby reducing the amount of sealant needed.

Best Mode for Carrying Out the Invention

Figure 1:
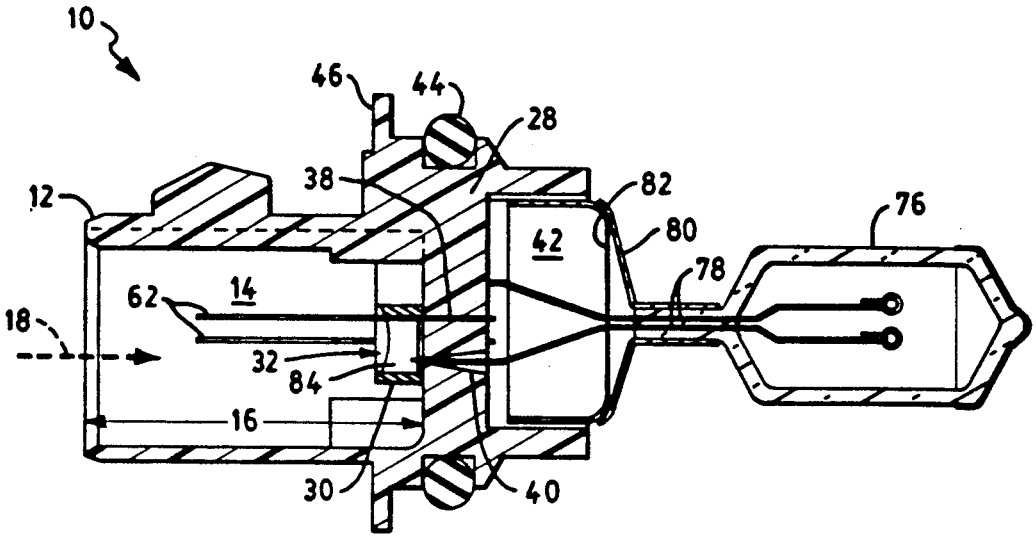
FIG. 1 shows a cross sectional view of a preferred embodiment of a headlamp lamp capsule including lug wells.
Figure 2:
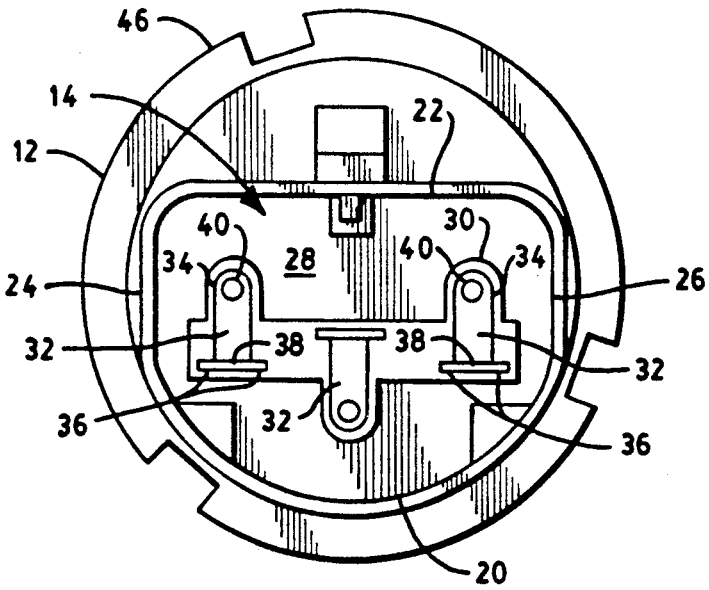
FIG. 2 shows a plug end view a preferred embodiment of a base including lug wells.

FIG. 1 shows a cross sectional view of a preferred embodiment of a headlamp lamp capsule including lug wells. FIG. 2 shows a plug end view a preferred embodiment of a headlamp lamp capsule including lug wells. The headlamp capsule 10 may be assembled from a base 12, one or more lugs 62, a light source 76 having two or more leads 78, a light source support means, and a quantity of potting 84 material.

The base 12 has a plug chamber 14, an intermediate wall 28, and a lamp chamber 42. The preferred base 12 is a molded plastic body. The plug chamber 14 is designed as plug recepticle to receive an end connector from a wire. The plug chamber 14 may include keying, guide or locking elements as are known in the art to help position or hold the plug end of a power source. The preferred plug chamber 14 has a tubular extension 16, about an axis 18, and is semicircular on a first side 20, straight walled on an opposite second side 22, and has a straight third side 24 and straight fourth side 26 linking the semicircular side 20, and the second side 22. The corners between the sides are rounded. The base 12, at the inner extension of the plug chamber 14 has an intermediate wall 28. The preferred intermediate wall 28 extends transversely to the plug chamber 14 axis 18. The intermediate wall 28 then spans the interior end of the plug chamber 14.

Facing the plug chamber 14, and molded as part of the intermediate wall 28 is an upstanding wall 30. The wall 30 has a height that is greater than the thickness of the lug 48. In one embodiment, the wall 30 had a height that was about eight times greater than the thickness of the lug foot 56. Formed in the wall 30 as a sunken regions or surrounded by the wall 30, may be one or more lug wells 32. The surface of the intermediate wall 28 facing the plug chamber, may then be approximately co-planar with the interior limit, or bottom of the lug well 32. The preferred lug well 32 may also be a molded portion of the intermediate wall 28 coformed with the base 12 as a single unit. The area of the intermediate wall 28 is substantially larger than the area enclosed by the lug wells 32. The lug well 32 has a tubular form with an axis extending parallel with the plug chamber 14 axis 18. The preferred lug well 32 further has an approximately fixed cross sectional form, thereby allowing smooth insertion of a complimentarily formed body.

The preferred lug well 32 is defined by an interior wall 34. The interior wall 34 may include opposed slots 36 extending parallel with the plug chamber 14 axis 18. The slots 36 are positioned in the interior wall 34 to form one side of the lug well 32. The opposite side of the interior wall 34 may be formed to have a particular cross sectional shape that may be used to mate or guide a portion of a lug 48. In the preferred embodiment, the opposite side of the interior wall 34 has a semicircular form that mates with a semicircular toe end 62 of the lug foot 56.

At the interior end of the lug well 32, formed as a continuation of the slots 36 may be a lug passage 38. Extending through the intermediate wall 28, the lug passage 38 connects to the lamp chamber 42. The lug passage 38 should be sufficiently large to accept the insertion of a lug stake 68. The preferred lug passage 38 is a rectangular hole having a minor dimension, and a major dimension respectively close to the minor dimension and major dimension of the lug stake 68. At the interior end of the lug well 32, extending through the intermediate wall 28 and offset from the lug passage 38, is a lead passage 40 that also connects to the lamp chamber 42. The lead passage 40 should have sufficient diameter to allow the insertion of an electric lamp lead 78. The preferred lead passage 40 is a conical hole with the peak of the cone facing the plug chamber 14.

Positioned on the opposite side of the base 12 from the plug chamber 14, and separated from the plug chamber 14 by the intermediate wall 28 is a lamp chamber 42. Extending from the interior end of the lug well 32, the lug passage 38 and the lead passage 40 pass into the lamp chamber 42. The lamp chamber 42 may have a tubular form, with positioning, guiding, supporting or other formed features known in the art of headlamp capsule construction.

The exterior of the base 12 may include aligning, coupling and sealing features as is generally known in the art. The preferred embodiment includes three coaxially alignment slots for correctly positioning the capsule 10 in a headlamp reflector. An 0-ring seal 44 may be included along the exterior of the preferred embodiment, along with a ring with three slots 46 used for coupling the base 12 to a lock ring to hold the capsule 10 in place in a headlamp reflector. Other, aligning, sealing and coupling features may be adapted along the exterior of the base 12 as may be elected by the user.

Figure 3:
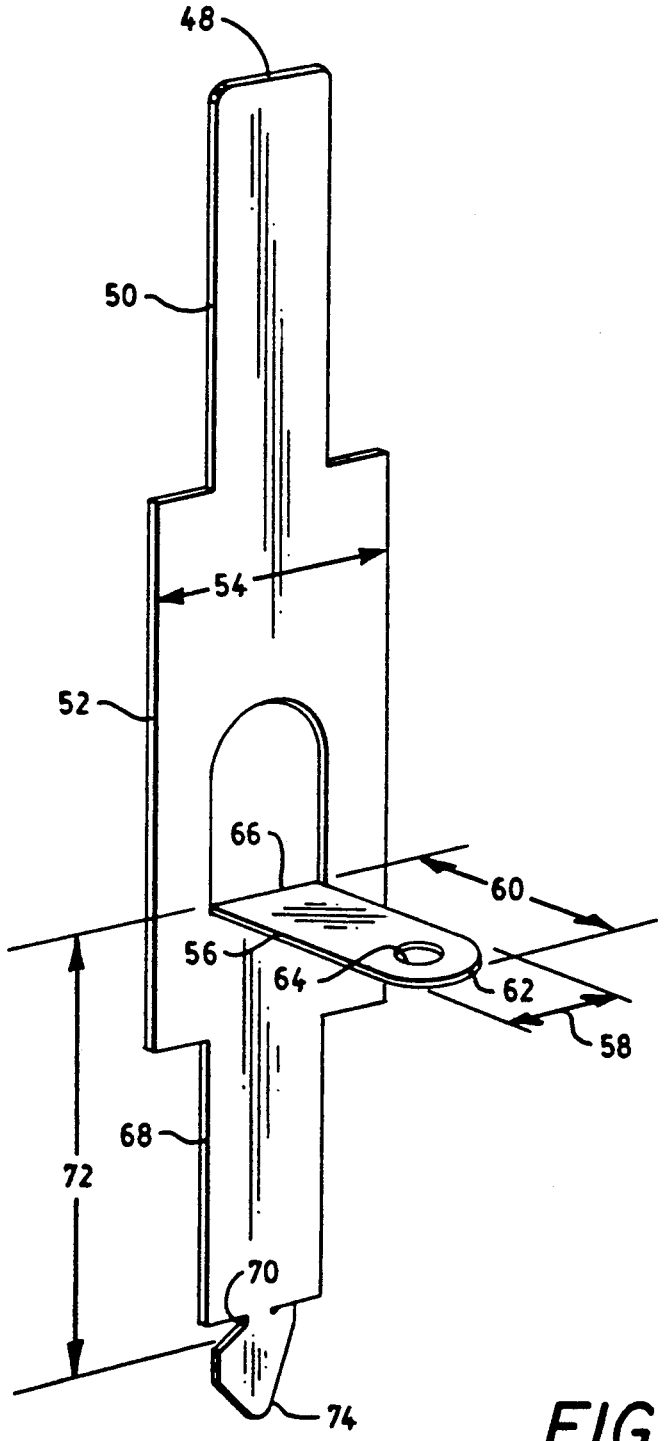
FIG. 3 shows a perspective view of a preferred embodiment of a lug.

Inserted in the lug well 32 is a lug 48. FIG. 3 shows a perspective view of a preferred embodiment of a lug 48. The preferred lug 48 is a metal piece stamped from a tin plated, flat brass sheet. The lug includes a connector end 50, a middle section 52, a lug foot 56, and a stake 68. The connector end 50 has a length and width conveniently chosen to be used as a plug end, thereby forming the familiar blade of a plug connector. The flat bar portion of the connector end 50 extends for a length sufficient to be securely mated with a female plug connector. The preferred middle section 52 has a width 54 nearly equaling the separation between the opposed slots 36 in the lug well 32. Formed in the middle section 52 may be a lug foot 56 with a width 58, and length 60 and a shape to be aligned with and fit closely with the interior wall 34 of the lug well 32. The toe end 62 of the lug foot 56 may be formed to complement the shape of the second lug well wall. The lug well 32 wall opposite the slots 36, may thereby assist in aligning and holding the lug 48 properly by the coacting conformal contact with the toe end 62. The preferred toe end 62 has a semicircular shape. Formed in the lug foot 56 may be an eyelet 64 to receive and be welded to a lamp lead 78. The lug foot 56 may be stamp cut on three sides and then hinged ninety degrees to the middle section 52. Extending from the middle section 52 from the hinge 66 is a lug stake 68 having a size complementary of the lug passage 38, and a length greater than the thickness of the intermediate wall 28 from the bottom of the lug well 32 through to the lamp chamber 42. In one embodiment, the lug stake 68 included a neck 70, where the distance 72 from the hinge 66 to the neck 70 equaled the thickness of the intermediate wall 28. The stake 68 then ended with a twist tab 74.

The lug 48 is positioned in the lug well 32 by first inserting the twist tab 74 in the lug well 32 to pass through the lug passage 38 thereby aligning the lug 48 in the lug well 32, and aligning the outside edges of the middle section 52 to fit in the oppose slots 36. The lug 48 is then advanced in the lug well 32, with the lug edges sliding in the opposed slots 36. As the lug 48 is advanced into the lug well 32, the lug foot 56 passes into the lug well 32 and is aligned around the lug foot's perimeter by the interior wall 34. With further advancement, the lug foot 56 bottoms against the interior end of the lug well 32. The stake 68 extends through the lug passage 38 to expose the twist tab 74 in the lamp chamber 42. The twist tab 74 is then grasped and twisted about forty-five degrees. Due to the close fit between the lug passage 38 and the stake 68, the bend causes the neck 70 or twist tab 74 to cut into and closely bind with the base 12. The twisting pulls the lug 48 in tight against the base 12 and holds the lug 48 permanently in place. Meanwhile connection end 50 is well aligned because the interior wall 34 positions the lug foot 56, and the opposed slots 36 position middle section 52.

The base 12 is designed to support a light source 76. The light source 76 may be a standard tungsten halogen lamp bulb, having a filament enclosed in a glass or quartz envelope. The light source 76 is supported at an end from which two or more leads 78 emerge for electrical connection to provide electric power to the filaments. While a filament structure is disclosed, the present design may be used with an arc discharge or other electrically powered light source 76. The preferred envelope is a quartz tube having a press sealed end with either two or three leads 78 emerging to provide power for the one or two enclosed tungsten lamp filaments. In the preferred light source 76 support structure, the pressed end of the light source 76 is held by a clamp 80. Inserted snugly in the lamp chamber 44 against the axial ribs and fused in place may be a metal insert ring 82. The light source 76 and clamp 80 assembly may then be optically aligned on and welded to the metal ring 82.

The base 12 guides the lead 78 to the plug chamber 14 by the conical lead passage 40 extending from the lamp chamber 42. The leads 78 then extend to plug chamber 14 by way of the conical lead passage 40 and the lamp chamber 42, from the press sealed end of the light source 76, so electrical connection to the lug 48 may be made at the eyelet 64. By way of example the leads 78 are shown as round molybdenum wires, although the leads 78 may be of any other suitable material or cross sectional configuration.

The lug well 32 is then filled, either partially or fully with a selected potting 84 material. The potting 84 material is then cured to form a sealed covering for the lug foot 68 and the lead to lug electrical connection. The potting 84 may be a liquid sealant that may be cured to form a water resistant covering for the lug foot 56 and the lead to lug connection at the eyelet 64. The potting 84 should then have sufficient liquidity to wet and fill the volume of the lug well 32 around the lug 48. In the present design, the potting 84 flows through the hole left in the middle section 52 by the hinged down lug foot 56. The potting 84 then more easily fills the region between the wall 36 and the lug 48. The potting 84 material is selected to seal well with the base 12 material, and the lug material. The potting 84 material is also selected to be durable through temperature extremes the lamp is subjected to, and resistant to oxygen, water, and other materials that may contact the potting 84. The preferred liquid sealant is a fast curing silicon sealant.

In a working example of a 9004 type lamp, some of the dimensions were approximately as follows: The capsule had an overall height of 95.4 millimeters, a diameter at the O-ring seal of about 36.0 millimeters. The plug chamber had a depth of about 34.8 millimeters, and included three lug wells positioned along the intermediate wall formed by a wall extending from the intermediate wall. The lug well had a slot width of about 5.6 millimeters, a foot width of about 3.3 millimeters, and a foot length of about 7.1 millimeters. The side of the lug well opposite the slots had a semicircular form. The lug wells had a depth of about 4.3 millimeters. The lugs had about a 2.4 centimeter extension form the intermediate wall. The lugs had a length of 3.2 centimeters, a connector end width of 3.0 millimeters, a middle section width of 5.6 millimeters, and a foot to twist tab length of about 8.0 millimeters. The lug foot length was about 7.1 millimeters; the width was about 3.3 millimeters and the thickness was about 0.6 millimeters. The area of the three lug wells was about 70.29 square millimeters. The area of the intermediate wall was about 417.0 square millimeters. The amount of potting required to cover the lug feet, and the lug to lead welds was then about six times less when the lug well design was used. The lugs were found to be consistently centered and aligned, and well potted by the use of the lug well structure.

The disclosed dimensions, configurations and embodiments are as examples only, and other suitable configurations and relations may be used to implement the invention. While there have been shown and described what are at present considered to be the preferred embodiments of the invention, it will be apparent to those skilled in the art that various changes and modifications can be made herein without departing from the scope of the invention defined by the appended claims.

What may be claimed may be:

1. A base for a for headlamp capsule comprising: a molded body having an open ended plug chamber, the plug chamber having an axis, the molded body further having an intermediate wall formed as an end of the plug chamber and which has a cross sectional area within said plug chamber, a lamp chamber formed on the opposite side of the intermediate wall, a walled region formed on the intermediate wall having an interior wall defining a surrounded lug well, the lug well having a cross sectional area substantially less than the plug chamber cross sectional area of the intermediate wall, and having a lug passage with a minor width, and formed to extend from the lug well, through the intermediate wall to the lamp chamber.

2. The base in claim 1, wherein the interior wall defines two slots adjacent, and aligned with the lug passage.

3. The base in claim 2, wherein the slots are coplanar, are coaxial with the plug chamber axis, and have the same minor width as the lug passage.

4. The base in claim 1, wherein the interior wall has a height coaxial with the plug chamber axis substantially in excess of the minor width of the lug passage.

5. The base in claim 1, further including a lead passage formed to extend from the lug well through the intermediate wall to the lamp chamber, having sufficient size to receive a lamp lead.

6. The base in claim 5, wherein the lead passage comprises a conical shaped hole which narrows towards the plug chamber.

7. The base in claim 1, wherein the lug passage includes a planar portion, coplanar with a first side of the interior wall.

8. The base in claim 7, wherein the interior wall further defines a semicircular shaped side opposite the first side.

9. The base in claim 7, further including a lead passage offset from the lug passage, and formed to extend from the lug well through the intermediate wall to the lamp chamber, having sufficient size to receive a lamp lead.

10. The base in claim 9, wherein the lead passage comprises a conical shaped hole which narrows towards the plug chamber.

11. A vehicle lamp capsule comprising:

a) a molded body having an open ended plug chamber, the plug chamber having an axis, the molded body further having an intermediate wall formed as an end of the plug chamber and which has a cross sectional area within said plug chamber, a lamp chamber formed on the opposite side of the intermediate wall, a walled region formed on the intermediate wall having an interior wall defining a surrounded lug well, the lug well having a cross sectional area substantially less than the plug chamber cross sectional area of the intermediate wall, and having a lug passage with a minor width, and formed to extend from the lug well, through the intermediate wall to the lamp chamber, b) a lug having a connection end, and a stake end positioned in the lug passage, c) potting positioned in the lug well intermediate the base and the lug to seal the base and lug, c) a light source, d) two or more leads emerging from the light source, at least one of which extends through the lamp chamber and is electrically coupled to the lug, and e) means for coupling the light source to the lamp chamber.

12. The lamp capsule in claim 11, wherein the interior wall defines two slots adjacent, and aligned with the lug passage.

13. The lamp capsule in claim 11, wherein the lug includes side portions positioned in the slots.

14. The lamp capsule in claim 12, wherein the slots are coplanar, are coaxial with the plug chamber axis, and have the same minor width as the lug passage.

15. The lamp capsule in claim 14, wherein the lug includes side portions positioned in the slots.

16. The lamp capsule in claim 11, wherein the interior wall has a height coaxial with the plug chamber axis substantially in excess of the minor width of the lug passage.

17. The lamp capsule in claim 11, further including a lead passage formed to extend from the lug well through the intermediate wall to the lamp chamber, having sufficient size to receive a lamp lead.

18. The lamp capsule in claim 17, wherein the lead passage comprises a conical shaped hole which narrows towards the plug chamber.

19. The lamp capsule in claim 11, wherein the lug passage includes a planar portion, coplanar with a first side of the interior wall.

20. The lamp capsule in claim 19, wherein the interior wall further defines a semicircular shaped side opposite the first side.

21. The lamp capsule in claim 19, further including a lead passage offset from the lug passage, and formed to extend from the lug well through the intermediate wall to the lamp chamber, having sufficient size to receive a lamp lead.

22. The lamp capsule in claim 21, wherein the lead passage comprises a conical shaped hole which narrows towards the plug chamber.

23. The lamp capsule in claim 11, wherein the lug includes a lug foot extending from the lug at about ninety degrees.

24. The lamp capsule in claim 11, wherein the lug foot has a perimeter substantially complementary with the interior wall adjacent the intermediate wall to thereby assist in forming an aligning contact between the interior wall of the lug well and the lug foot.

25. The lamp capsule in claim 23, where in the lug foot includes an eyelet positioned adjacent an end of the lead passage to thereby receive and be connected to an end of a lead.

26. The lamp capsule in claim 23, wherein the interior wall has a height which is substantially greater than a thickness of the lug foot.

* * * * *